US005791016A

United States Patent [19]

Lenz

[11] Patent Number: 5,791,016

[45] Date of Patent: Aug. 11, 1998

[54] HINGE FOR GLASS DOORS

[75] Inventor: Günter Lenz, Höchst, Austria

[73] Assignee: Julius Blum Gesellschaft m.b.H., Höchst, Austria

[21] Appl. No.: 712,545

[22] Filed: Sep. 11, 1996

[30] Foreign Application Priority Data

Sep. 15, 1995 [AT] Austria ..... A 1533/95

[51] Int. Cl.[6] ..... E05D 7/10

[52] U.S. Cl. ..... 16/258; 16/235; 16/254

[58] Field of Search ..... 16/235–238, 257, 16/258, 254, 382, 368, 369

[56] References Cited

U.S. PATENT DOCUMENTS

| | | | |
|---|---|---|---|
| 4,590,641 | 5/1986 | Lautenschlager et al. | 16/238 |
| 4,785,496 | 11/1988 | Motyka et al. | 16/223 |
| 4,800,621 | 1/1989 | Rock et al. | 16/254 |
| 4,850,080 | 7/1989 | Rock et al. | 16/258 |
| 4,976,006 | 12/1990 | Lautenschlager | 16/257 |
| 5,025,530 | 6/1991 | Ferrari et al. | 16/236 |
| 5,056,189 | 10/1991 | Brustle et al. | 16/235 |
| 5,056,190 | 10/1991 | Rock et al. | 16/257 |
| 5,159,740 | 11/1992 | Brustle et al. | 16/258 |
| 5,224,242 | 7/1993 | Marjanovic | 16/258 |
| 5,253,390 | 10/1993 | Gross et al. | 16/257 |
| 5,481,782 | 1/1996 | Grabher | 16/258 |

FOREIGN PATENT DOCUMENTS

| | | |
|---|---|---|
| 23 57 612 | 5/1975 | Germany . |
| 33 47 798.1 | 10/1985 | Germany . |

*Primary Examiner*—Chuck Mah
*Attorney, Agent, or Firm*—Wenderoth, Lind & Ponack

[57] ABSTRACT

A hinge has a base plate which may be secured to a furniture side wall and on which is anchored a hinge arm. The hinge arm is connected by way of articulated levers to an anchoring device to be connected to a glass door. The anchoring device includes a holding plate which may be joined by adhesion to the glass door and in which a coupling part articulated to the articulated levers may be suspended. Mounted on the coupling part is a spring-loaded tilting lever which, in the assembled position, latches behind a hook-like projection on the holding plate.

21 Claims, 8 Drawing Sheets

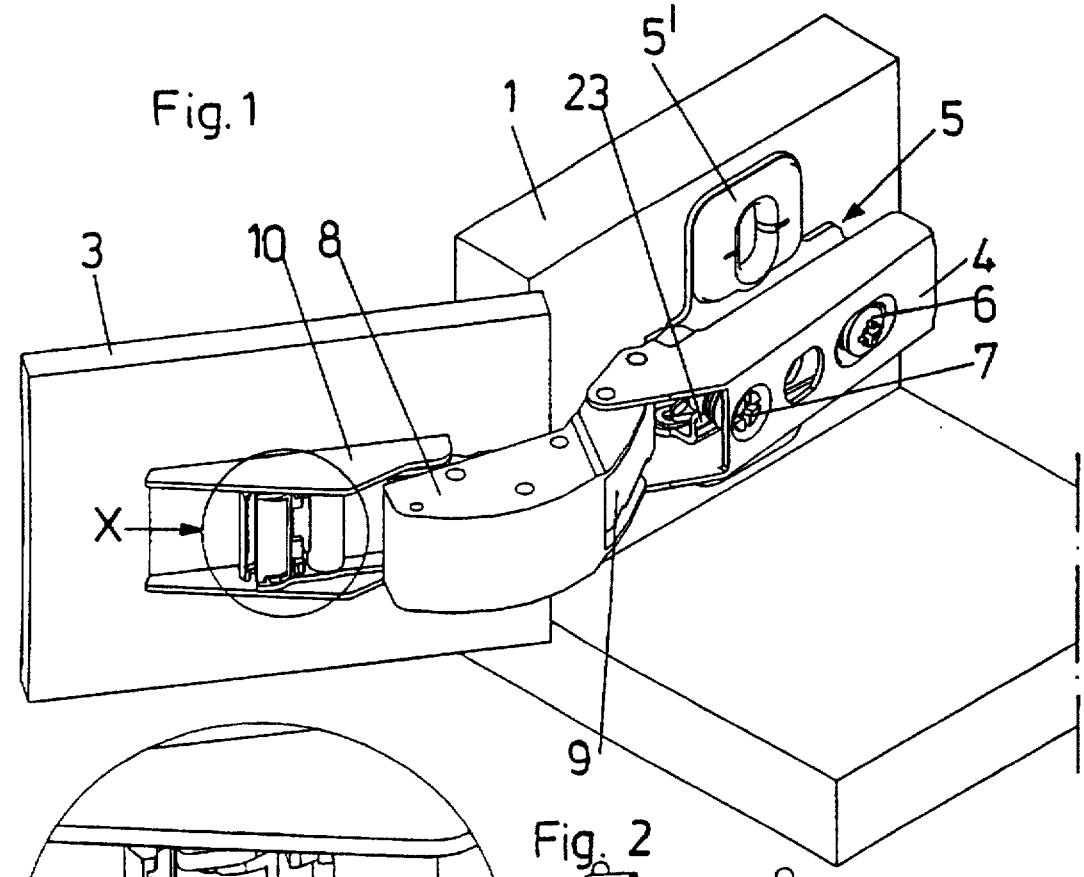
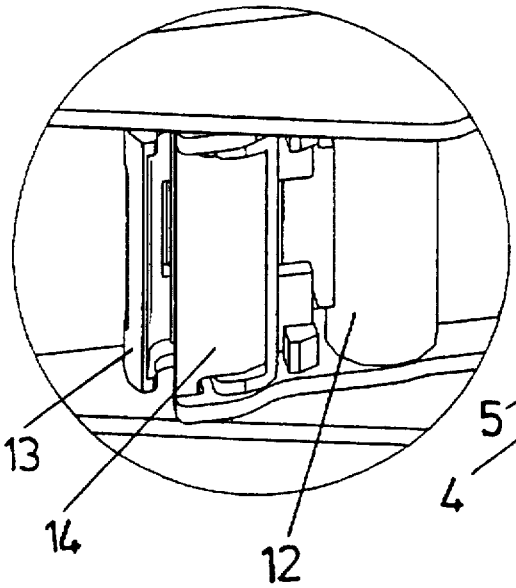
Fig. 1a
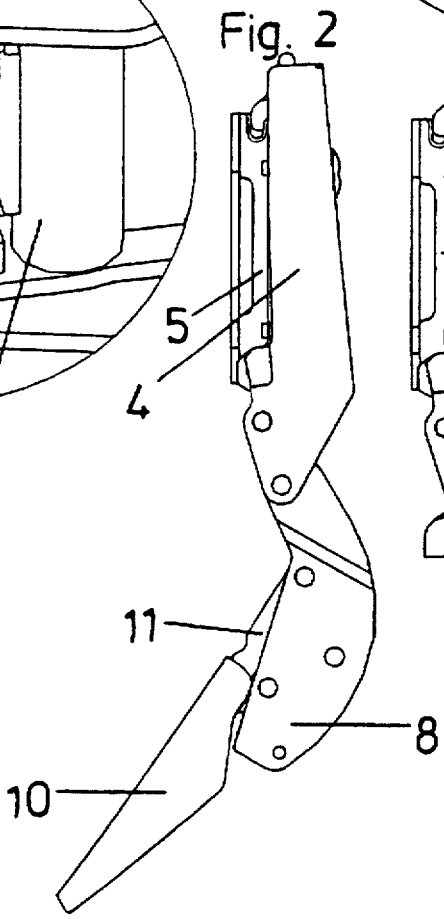
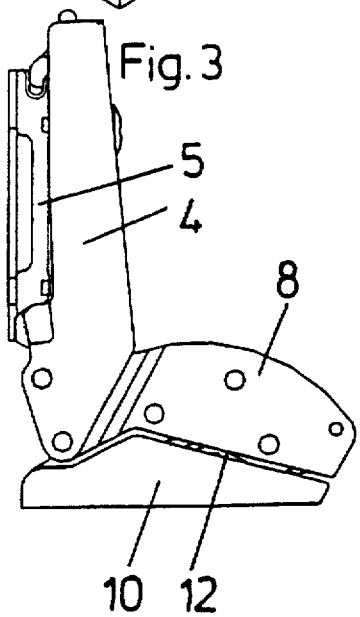

HINGE FOR GLASS DOORS

BACKGROUND OF THE INVENTION

The invention relates to a hinge for a glass door and having a base plate which may be secured to a furniture side wall and on which there may be anchored a hinge arm which is connected by way of at least two articulated levers to an anchoring means to be mounted on the door.

SUMMARY OF THE INVENTION

The object of the invention is to provide an improved hinge of this type such that no special processing of the glass door is necessary for assembly and such that anchoring of the glass door to a furniture carcass can be carried out rapidly without tools.

This object according to the invention is achieved in that the anchoring means on the door side includes a holding plate which may be joined to the glass door and in which a coupling part articulated to the articulated levers may be suspended, there being mounted on the coupling part a spring-loaded tilting lever which, in the assembled position, latches behind a hook-like projection on the holding plate.

In the hinge according to the invention, the holding plate preferably is joined by adhesion to the glass door by the manufacturer of the glass door, and the glass door is supplied to the furniture manufacturer with holding plates attached by adhesion. When the article of furniture is put together, the glass door is assembled merely by pressing the coupling part onto the holding plate.

Particularly good anchoring of the coupling part to the holding plate is achieved in that the holding plate is provided with a further hook-like projection on which the coupling part may be suspended, with the two projections pointing in mutually opposing directions, in that the coupling part is articulated by way of two articulation pins to two articulated levers, in that one of the articulation pins may be suspended on one of the hook-like projections on the holding plate, and in that the second articulation pin bears against a stop on the holding plate which is arranged between the two projections on the holding plate.

BRIEF DESCRIPTION OF THE INVENTION

An embodiment of the invention will be described in detail below with reference to the attached drawings, wherein:

FIG. 1 is a perspective view of a hinge according to the invention shown in an opened position, and parts of a furniture side wall or carcass and a glass door;

FIG. 1*a* is an enlarged view of detail X of FIG. 1;

FIG. 2 is a side view of the hinge according to the invention in the opened position;

FIG. 3 is a side view of the hinge according to the invention shown in a closed position;

DETAILED DESCRIPTION OF THE INVENTION

Figure 4:
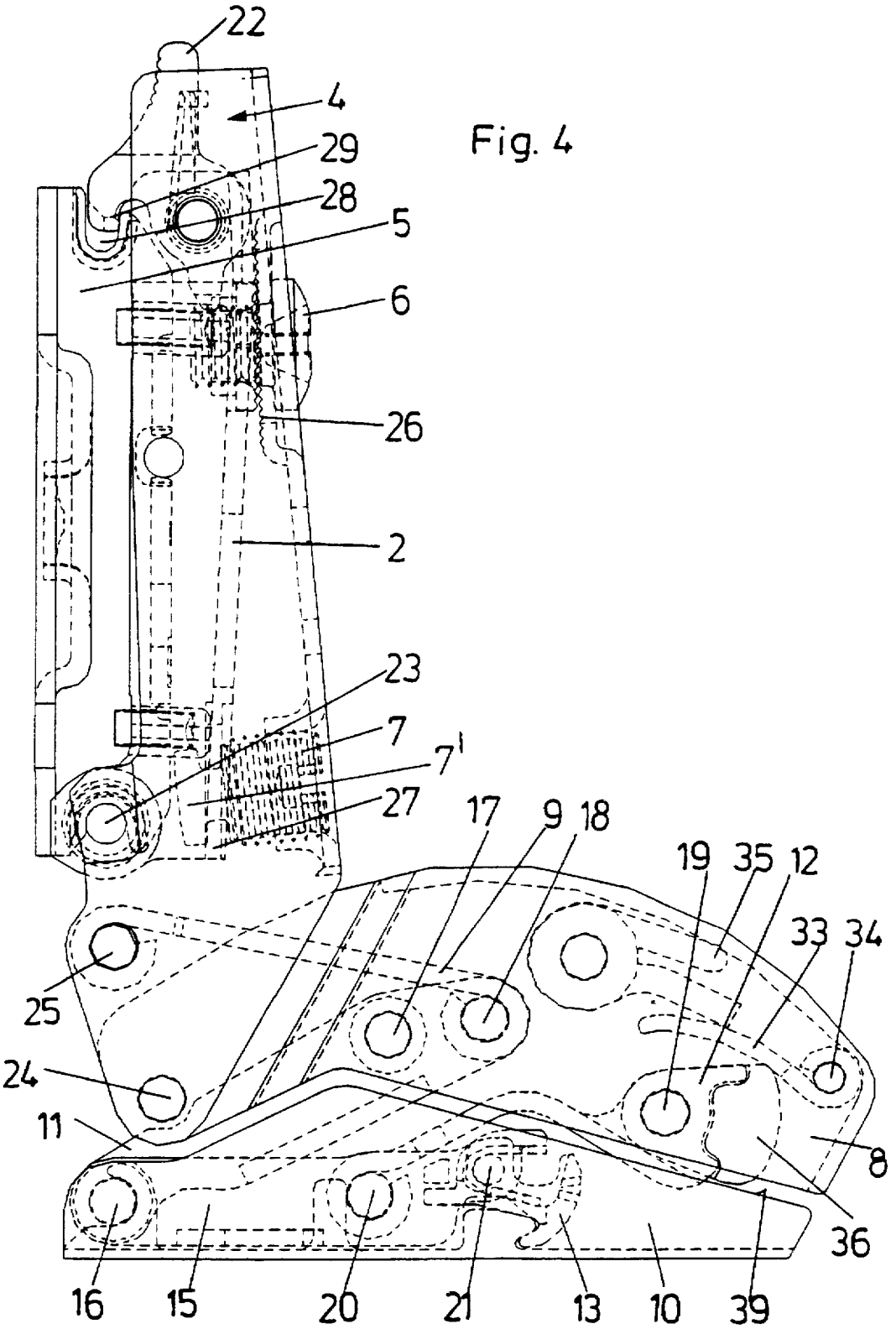
FIG. 4 is a side view of the hinge in the closed position, shown on an enlarged scale.

As can be seen from the drawings, the essential parts of the hinge of the invention on the side of furniture side wall 1 are a hinge arm 4, a base plate 5 and an intermediate piece 2 with a tilting lever 22. On the side of glass door 3, hinge includes a holding plate 10 and a coupling part 15. These two groups are connected articulatedly to one another by articulated levers 8, 9, 11, 12. The articulated levers 8, 9, 11, 12 allow an angle of opening of glass door 3 of more than 90°.

The hinge arm 4 is secured to the intermediate piece 2 by means of a gap-adjusting screw 7 which is mounted in a female thread in the hinge arm 4, and by means of a clamping screw 6 which also serves for depth adjustment. The clamping screw 6 projects through a longitudinal slot 26 in the hinge arm 4, and in a similar manner the gap-adjusting screw 7 has a head 7' extended through a longitudinal slot 27 in the intermediate piece 2. By loosening the clamping screw 6, the hinge arm 4 may be displaced over the length of the slot 26, and thus adjusted in a direction of the depth of the article of furniture. Adjustment in the direction of the furniture door gap takes place in a conventional manner by rotating the gap-adjusting screw 7.

The intermediate piece 2 is constructed with a U-shaped profile. The base plate 5 fits between arms or limbs of the intermediate piece 2. Base plate 5 has lateral flanges 5' by means of which it is attached to the furniture side wall 1. At the front, the intermediate piece 2 is provided with a continuous pin 23 which serves as a holding projection for the intermediate piece 2. The base plate 5 has at the front thereof a notch in which the pin 23 may be suspended, so that it is held against the base plate 5. At the rear end of base plate 5 is provided a notch 28. Tilting or pivot lever 22 is mounted at the rear end of the intermediate piece 2, and a hook 29 is constructed on the tilting lever 22.

The tilting lever 22 is acted upon by a spring so that, when the intermediate piece 2 is placed on the base plate 5, hook 29 clips automatically into the notch 28. On assembly, the hinge arm 4 is suspended by means of the pin 23 of the intermediate piece 2 in the base plate 5. In this arrangement, the hinge arm 4 is at an angle to the base plate 5. Subsequently, the hinge arm 4 is turned counterclockwise, as viewed in FIG. 4. The hinge arm 4 and the intermediate piece 2 are pressed toward the base plate 5, and the hook 29 latches into the notch 28, thus anchoring the hinge arm 4 to the base plate 5.

Mounted on the hinge arm 4 by means of respective pins 24, 25 are the two articulated levers 8, 9. The articulated lever 9 is connected by means of a pin 18 to articulated lever 11, and the articulated lever 8 is connected by means of a pin 19 to articulated lever 12. The articulated levers 11, 12 are in turn connected by way of pins 16, 20 to a coupling part 15. The articulated levers 8, 11 are connected to one another by way of a pin 17, so that the movement of the articulated levers 8, 9, 11, 12 is controlled on opening and closing of the glass door 3.

The holding plate 10 is constructed such that its cross-section is a U-shaped profile including two lateral webs 10' and a connecting web. Hook-like projections 30, 31 are provided on the connecting web. In the illustrated embodiment the holding plate 10 is secured to the glass door 3 by means of adhesion. Advantageously, a UV adhesive or an infrared adhesive is used, but conventional bicomponent adhesives may also be used.

Joining the holding plate 10 to the glass door 3 by adhesion has the advantage that the glass door 3 does not have to be processed, that is to say no holes have to be drilled in the glass door 3, and no cutouts for insertion of a hinge housing have to be cut out of glass door 3. The hook-like projections 30, 31 point in opposite directions.

Figure 5:
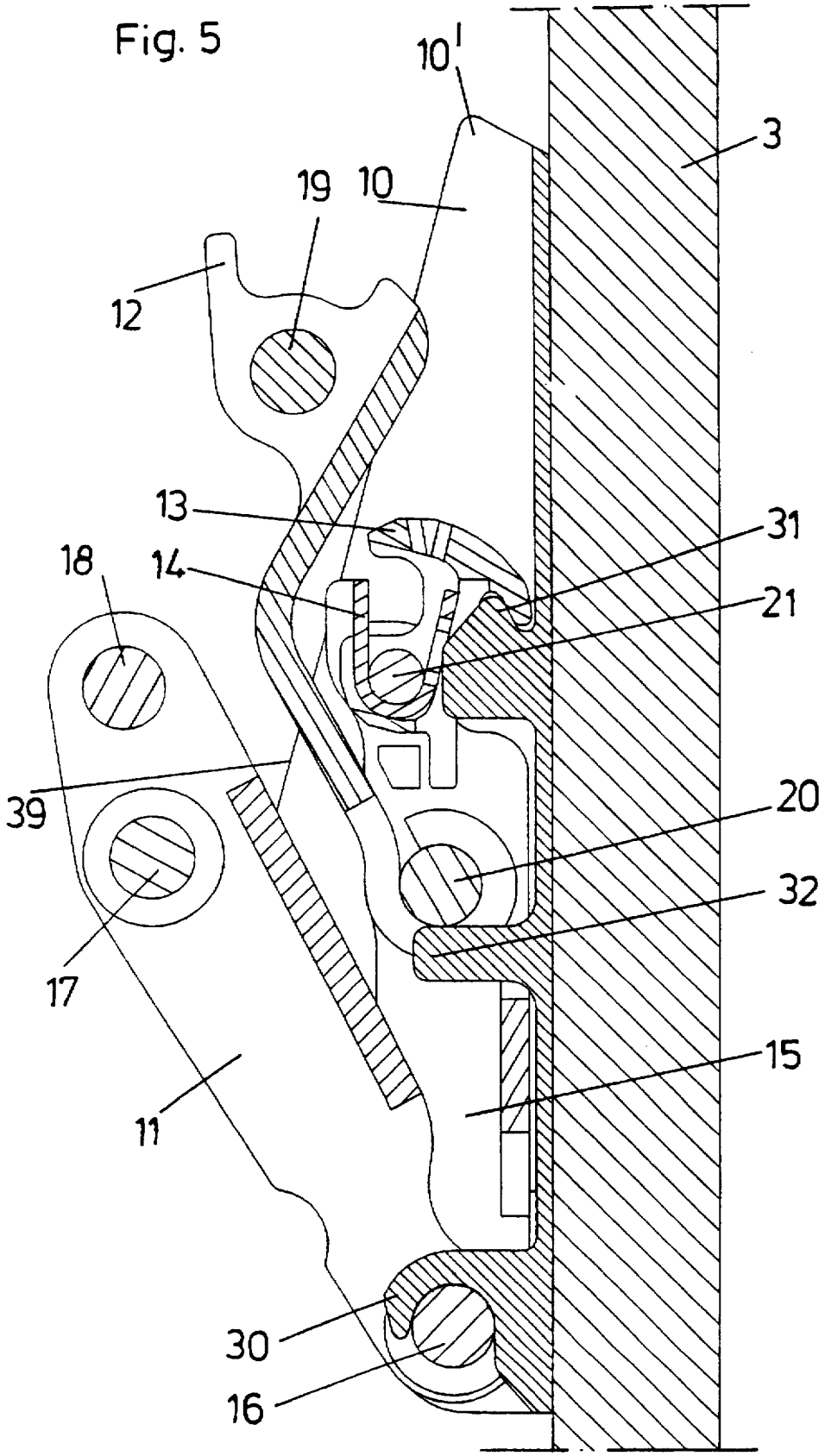
FIG. 5 is a longitudinal section through a holding plate, a coupling part and two articulated levers.
Figure 6:
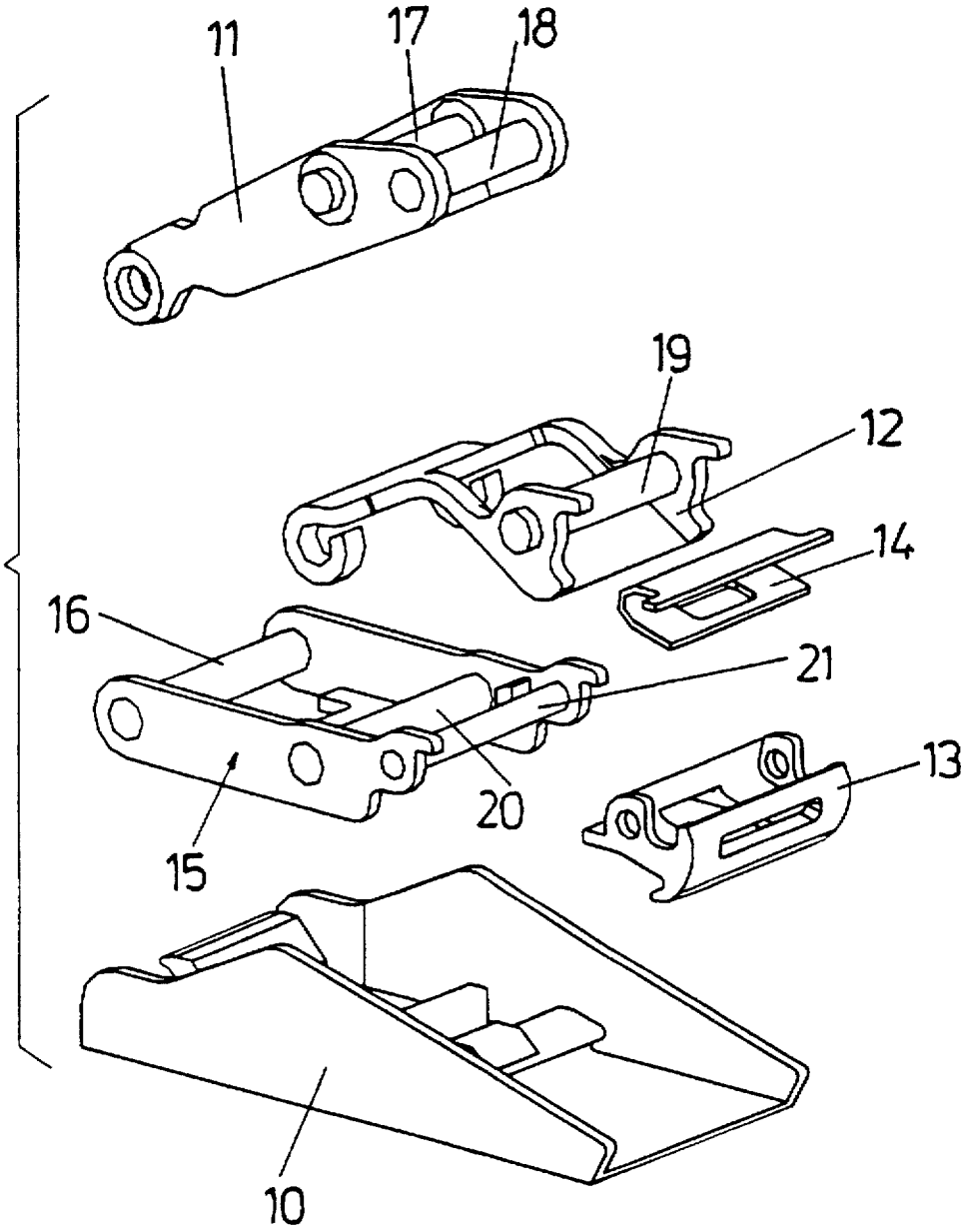
FIG. 6 is an exploded view of the two articulated levers, the coupling part, a tilting lever and the holding plate.

When the glass door 3 is to be connected to the hinge, pin 16 of the coupling part 15 engages the hook-like projection 30. Once again, as for assembly of the hinge arm 4, the coupling part 15 extends at an angle to the holding plate 10. The coupling part 15 then is turned clockwise as viewed in FIG. 5, until the pin 20 bears behind a stop 32 on the holding plate. As a result of this, the coupling part 15 is fixed on the holding plate 10 in relation to the length of the holding plate 10. The coupling part 15 is in this arrangement located between the two lateral webs 10' of the holding plate 10.

A tilting lever 13, which is acted upon by a spring 14, is mounted on the coupling part 15 by means of a pin 21. If the coupling part 15 is moved into the position shown in FIG. 5 relative to the holding plate 10, the tilting lever 13 latches behind the projection 31 on the holding plate 10, and the coupling part 15 is locked on the holding plate 10.

In the illustrated embodiment, a pressure contact plate 33 is mounted on the articulated lever 8 by means of a pin 34. Pressure contact plate 33 is acted upon by a leg spring 35, similarly mounted in the articulated lever 8, and presses against a control member 36 which is connected fast to the articulated lever 12. The control member 36 preferably is formed of a synthetic material, while the plate 33 preferably is constructed as a metal plate. By means of the pressure contact plate 33 and the leg spring 35, the hinge, even if it has been closed incompletely, is always pressed into the closed position and thus the glass door 3 is always closed precisely.

Figure 7:
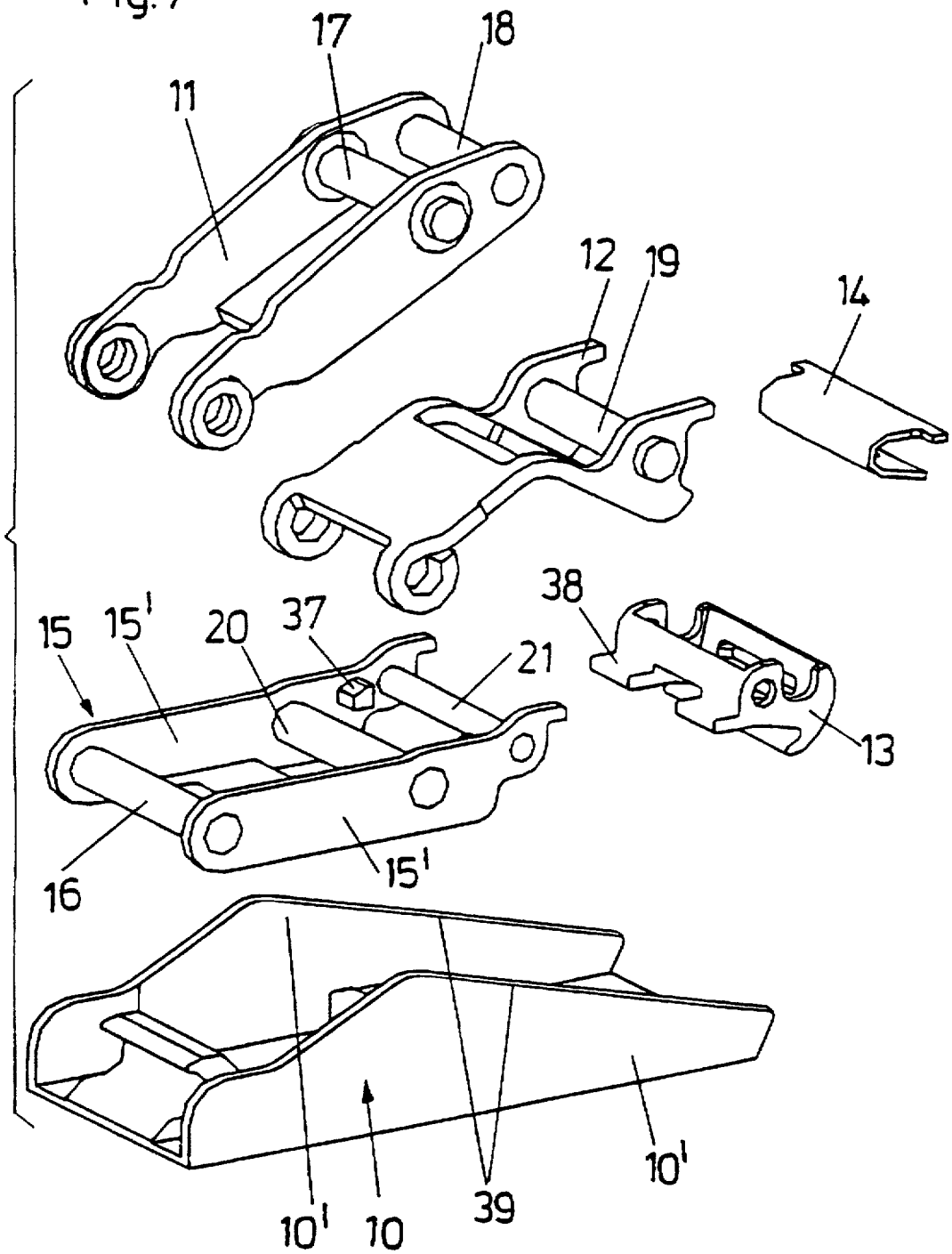
FIG. 7 is a view similar to FIG. 6, but viewed from the opposite side.
Figure 8:
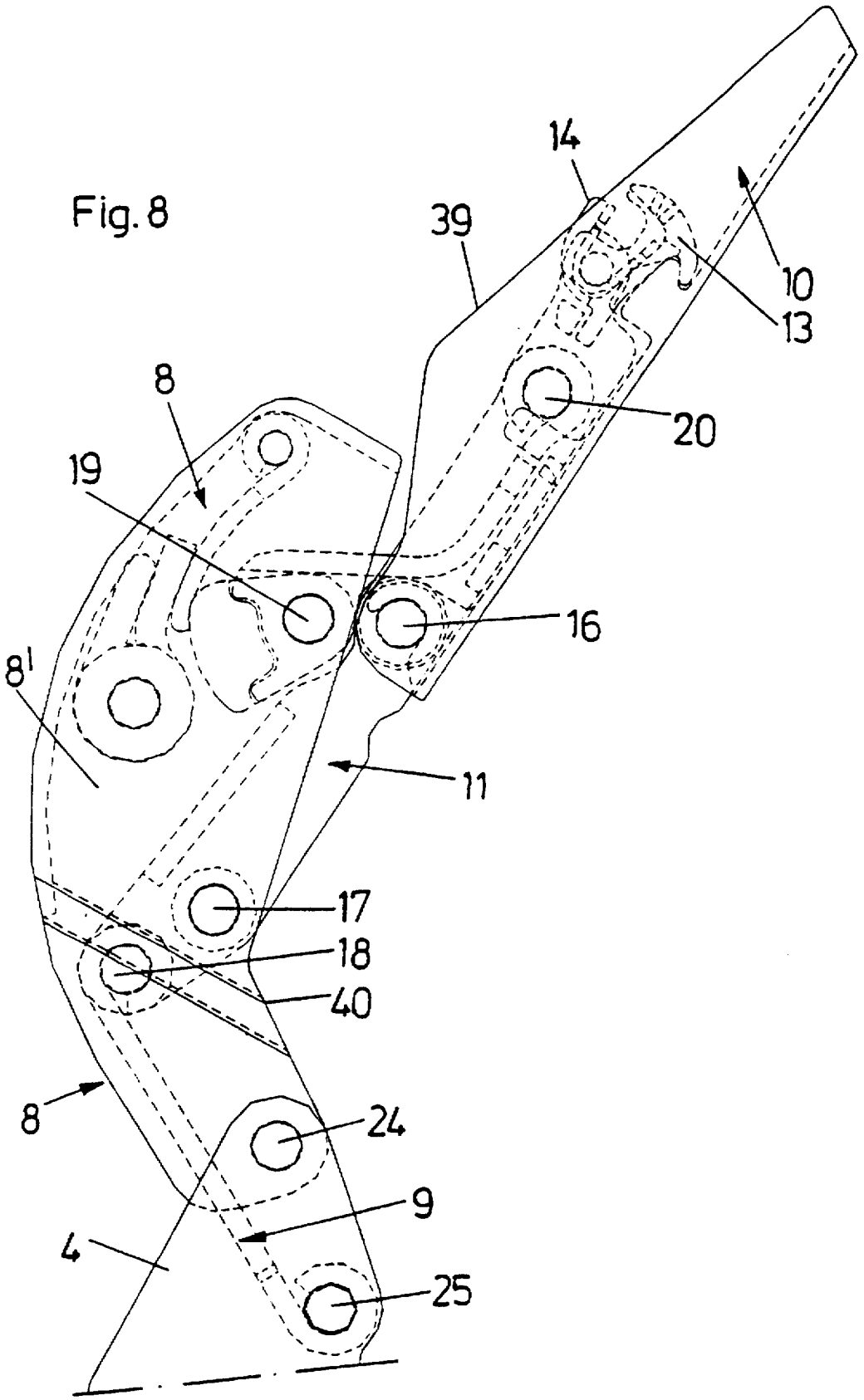
FIG. 8 is a side view of the articulated levers and the holding plate.
Figure 9:
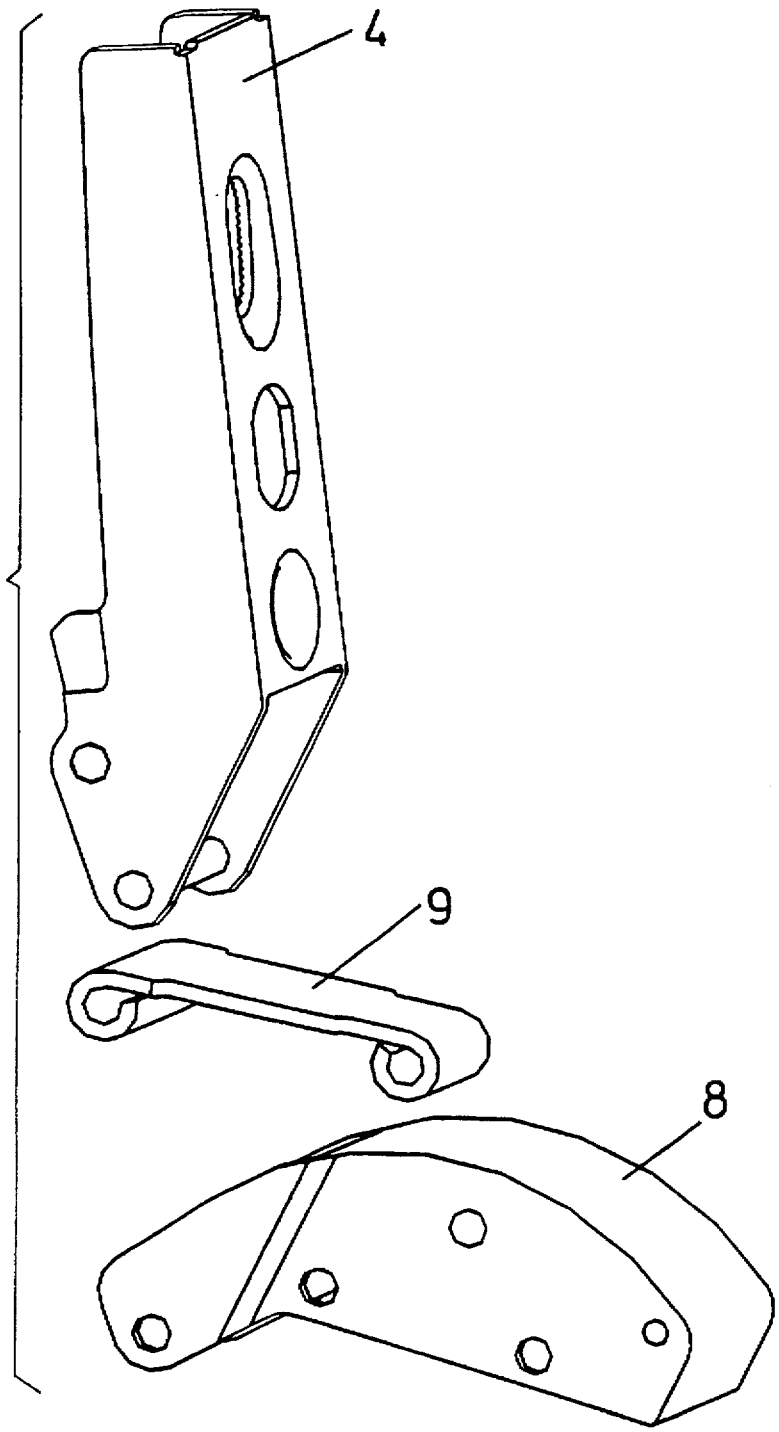
FIG. 9 is an exploded view of the hinge arm and the two articulated levers.
Figure 10:
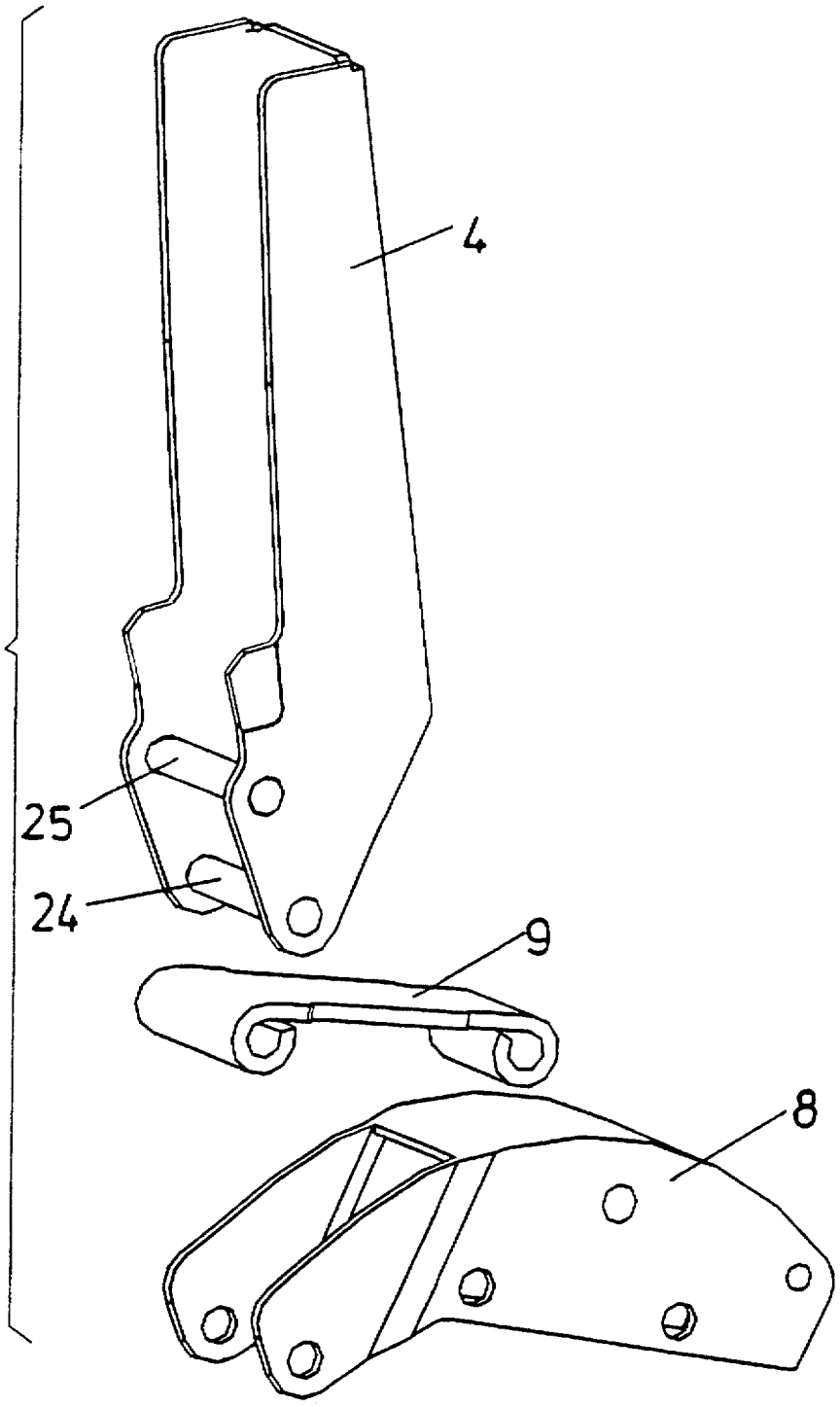
FIG. 10 is a view similar to FIG. 9, of the hinge but viewed from the opposite side.

As can be seen in particular from FIG. 7, the coupling part 15 has two cheeks or sides 15' which are connected by the two pins 16, 20 and the pin 21 carrying the tilting lever 13. The spring 14 acting on the tilting lever 13 advantageously is a leaf spring. A projection 37 is constructed on at least one cheek 15' of the coupling part 15, and an arm 38 of the tilting lever 13 bears against projection 37 when the coupling part 15 is not anchored in the holding plate 10.

The lateral webs 10' of the holding plate 10 are provided with projecting delimiting edges 39, which when the hinge is closed, are received in corresponding depressions 40 in lateral webs 8' of the articulated lever 8. The articulated lever 8 is also constructed such that its cross-section is a U-shaped profile, and when the hinge is closed the articulated lever 8 and the holding plate 10 together form, as seen in cross-section, a rectangle.

What is claimed is:

1. A hinge for mounting a glass door to an article of furniture, said hinge comprising:

a mounting plate to be fastened to a side wall of the article of furniture, said mounting plate having spaced notches;

a hinge arm;

an intermediate member fastened to said hinge arm, said intermediate member having a pin engageable in a first said notch and a pivot lever engageable in a second said notch, thereby enabling mounting of said intermediate member and said hinge arm on said mounting plate;

a holding plate to be fastened to the glass door, said holding plate having a hook-like projection; and a coupling part connected to said hinge arm by articulated levers, said coupling part being pivotally engageable with said holding plate and having a tilting lever engageable with said hook-like projection, thereby enabling mounting of said coupling part and said hinge arm to said holding plate.

2. A hinge as claimed in claim 1, wherein said pivot lever is biased in a direction to engage said second notch.

3. A hinge as claimed in claim 2, wherein said tilting lever is biased in a direction to engage said hook-like projection.

4. A hinge as claimed in claim 1, wherein said tilting lever is biased in a direction to engage said hook-like projection.

5. A hinge as claimed in claim 1, wherein said holding plate has a further hook-like projection, and said coupling part has a pin to engage said further hook-like projection, thus enabling pivotal engagement of said coupling part with said holding plate.

6. A hinge as claimed in claim 5, wherein said hook-like projection and said further hook-like projection extend in opposite directions.

7. A hinge as claimed in claim 5, wherein said pin of said coupling part pivotally connects said coupling part to a first said articulated lever.

8. A hinge as claimed in claim 7, wherein a second said articulated lever is pivotally connected to said coupling part by a further pin that bears against a stop on said holding plate when said coupling part is mounted on said holding plate.

9. A hinge as claimed in claim 8, wherein said stop is located at a position between said hook-like projection and said further hook-like projection.

10. A hinge as claimed in claim 1, wherein one of said articulated levers is pivotally connected to said coupling part by a pin that bears against a stop on said holding plate when said coupling part is mounted on said holding plate.

11. A hinge as claimed in claim 10, wherein said stop is located at a position between said hook-like projection and a position of pivotal engagement between said coupling part and said holding plate.

12. A hinge as claimed in claim 1, further comprising a control member on one of said articulated levers, and a contact member mounted on another of said articulated levers and operable to press against said control member.

13. A hinge as claimed in claim 12, further comprising a spring mounted on said another articulated lever to bias said contact member toward said control member.

14. A hinge as claimed in claim 1, wherein said holding plate has a U-shaped cross-sectional configuration defined by two side flanges connected by a connecting flange.

15. A hinge as claimed in claim 14, wherein one of said articulated levers has a U-shaped cross-sectional configuration.

16. A hinge as claimed in claim 15, wherein said side flanges of said holding plate have delimiting edges that fit in correspondingly configured recesses formed in side flanges of lateral webs of said one articulated lever.

17. A hinge as claimed in claim 14, wherein said hook-like projection extends from said connecting flange.

18. A hinge as claimed in claim 14, further comprising adhesive means covering said connecting flange to enable mounting of said holding plate to the glass door.

19. A hinge as claimed in claim 1, further comprising adhesive means on said holding plate to enable mounting thereof to the glass door.

20. A hinge as claimed in claim 1, wherein said coupling part has two sides that are connected by two articulation pins and by a bearing pin supporting said tilting lever.

21. A hinge as claimed in claim 20, wherein at least one of said sides has thereon a stop for said tilting lever.

* * * * *